United States Patent [19]

Wykes et al.

[11] Patent Number: 4,881,310

[45] Date of Patent: Nov. 21, 1989

[54] OVERHUNG ROLL ASSEMBLY

[75] Inventors: Philip Wykes, Shrewsbury; David L. Pariseau, Southbridge, both of Mass.

[73] Assignee: Morgan Construction Company, Mass.

[21] Appl. No.: 276,646

[22] Filed: Nov. 28, 1988

Related U.S. Application Data

[62] Division of Ser. No. 133,798, Dec. 16, 1987, Pat. No. 4,813,113.

[51] Int. Cl.[4] ..... B23P 19/00; B23P 19/04

[52] U.S. Cl. ..... 29/122; 29/129

[58] Field of Search ..... 29/117, 122, 129, 148.4 D

[56] References Cited

U.S. PATENT DOCUMENTS

| | | | |
|---|---|---|---|
| 3,761,008 | 9/1973 | Goulder | 29/117 X |
| 3,805,550 | 4/1974 | Patton | 29/129 X |
| 4,118,965 | 10/1978 | Grohoski | 29/129 X |
| 4,800,644 | 1/1989 | Muellenburg | 29/129 X |

*Primary Examiner*—Timothy V. Eley

*Attorney, Agent, or Firm*—Samuels, Gauthier, Stevens & Kehoe

[57] ABSTRACT

Disclosed is an annular roll for use in combination with a roll shaft having a tapered portion and an end portion, the roll surrounding the tapered shaft portion and having circumferentially spaced keys in an outer face thereof, an abutment engageable with an inner face of the roll to axially locate the roll on the roll shaft, a tapered sleeve axially received in a tightly wedged position between the roll and the tapered portion of the roll shaft, an axially shiftable drive ring connected to the sleeve and spline to the shaft for rotation therewith, the drive ring having lugs rotatably interengaged with the keys on the outer face of the roll, a first retainer engageable with the outer face of the roll to axially urge the roll against the abutment, and a second retainer engageable with and acting through the drive ring to prevent axial removal of the sleeve from between the roll and the tapered portion of the roll shaft, a tool for axially shifting the tapered sleeve into and out of its wedged position between the roll and the tapered portion of the roll shaft.

2 Claims, 5 Drawing Sheets

Fig. 4
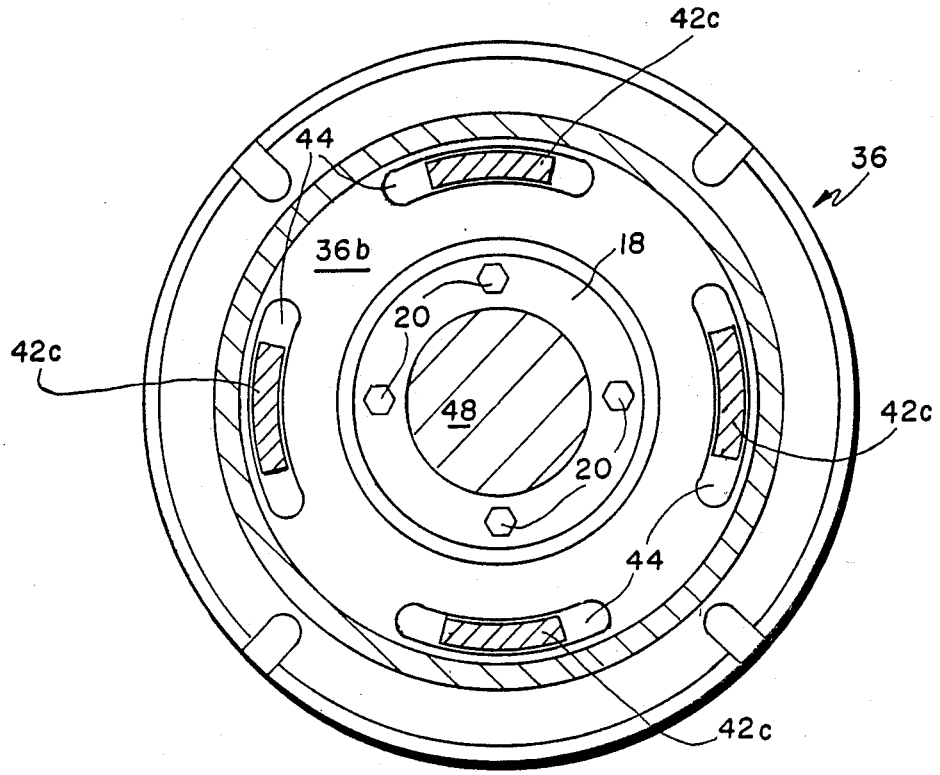
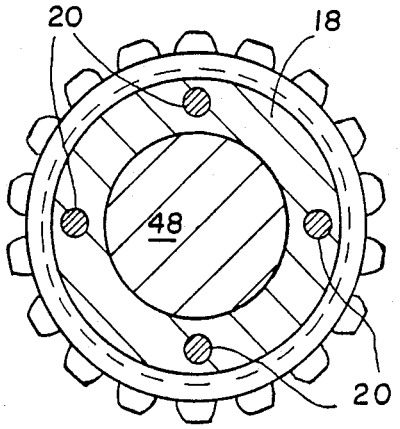
Fig. 5

OVERHUNG ROLL ASSEMBLY

This application is a divisional of application Ser. No. 07/133,798 filed Dec. 16, 1987, now Pat. No. 4,813,113.

BACKGROUND OF THE INVENTION

1. Field of the Invention

This invention relates generally to rolling mills, and is concerned in particular with an improved roll assembly of the "cantilevered" or "overhung" type commonly employed in the single strand rolling of steel rod and bar products.

2. Description of the Prior Art

In the above-mentioned type of roll assembly, care must be taken to avoid overstressing the roll material when operating under high load conditions. Overstressing can result from the high separating forces typically encountered when rolling at lower temperatures, or from roll profiles having increased groove depths, or from combinations of the foregoing. When such high stress conditions are encountered, conventional roll mounting assemblies of the type disclosed, for example, in U.S. Pat. No. 3,803,691, are no longer considered adequate.

A general objective of the present invention is to provide an improved roll assembly which minimizes roll stresses when rolling under high load conditions.

A more particular objective of the present invention is to provide an improved means of transmitting torque from the roll shaft to the work roll, while at the same time maintaining the work roll securely aligned concentrically with the roll shaft axis.

A further object of the present invention is to provide a roll assembly which can be rapidly and efficiently mounted on and removed from the roll shaft by means of a single hydraulically actuated tool.

SUMMARY OF THE INVENTION

In a preferred embodiment of the invention to be described hereinafter in greater detail, a rolling mill roll assembly includes a roll shaft having a tapered portion located adjacent to an end portion. An annular tungsten carbide work roll is received on the tapered shaft portion. The work roll has circumferentially spaced keys integrally formed on its outer face. A tapered sleeve is axially wedged between the work roll and the tapered shaft portion. A drive ring is connected to the sleeve. The drive ring is splined to the shaft end portion and is provided with lug members which are axially received between and which are rotatably engaged with the keys on the outer roll face. Driving torque is thus transmitted from the shaft to the roll via the driving ring, with the roll being concentrically located with respect to the shaft axis by the tapered sleeve.

BRIEF DESCRIPTION OF THE DRAWINGS

FIGS. 2, 3, 4 and 5 are sectional views taken respectively along lines 2—2, 3—3, 4—4 and 5—5 of FIG. 1;

DETAILED DESCRIPTION OF ILLUSTRATED EMBODIMENT

Figure 1:
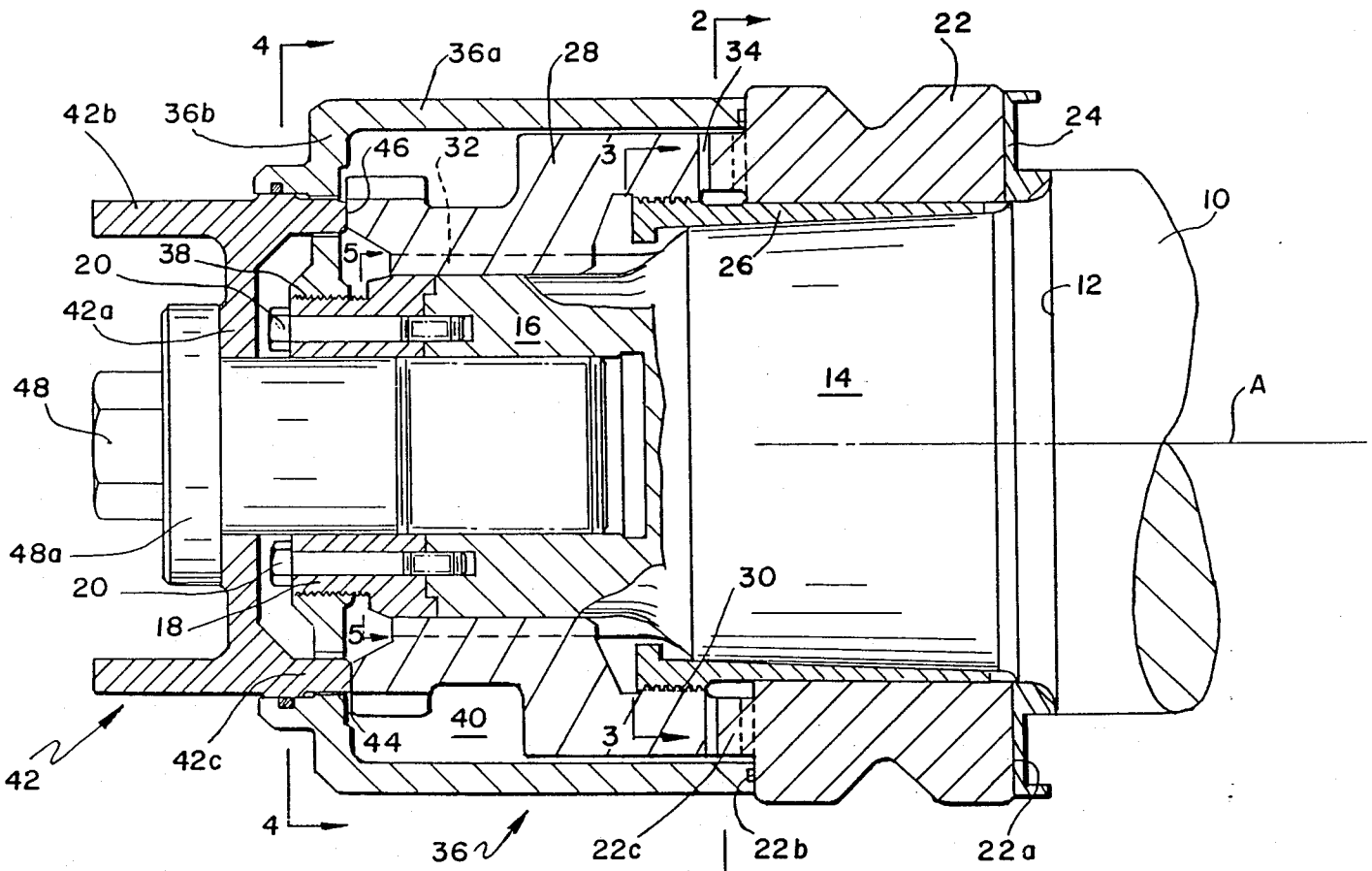
FIG. 1 is a sectional view through a rolling mill roll assembly in accordance with the present invention.
Figure 2:
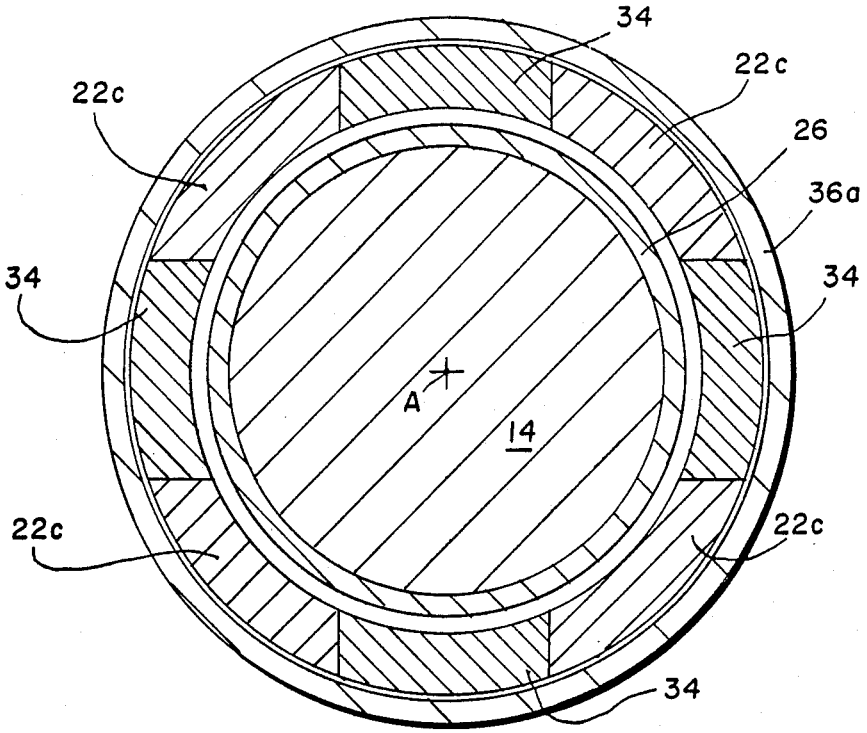
Figure 3:
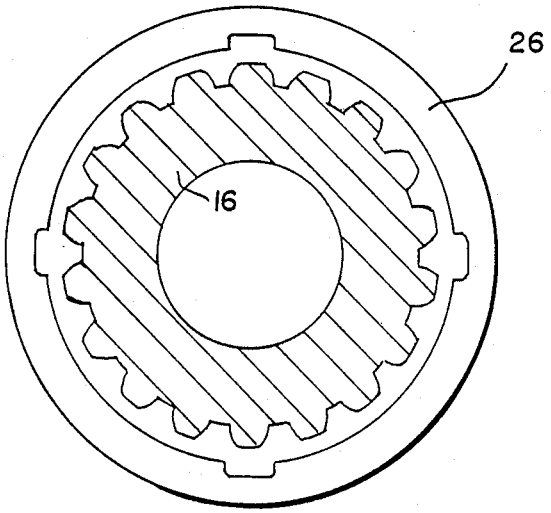

With reference initially to FIGS. 1–5, the roll assembly of the present invention includes a roll shaft 10 having a shoulder 12 leading to a tapered portion 14 which in turn leads to an end portion 16. An end cap 18 is secured to the shaft end by means of bolts 20.

An externally grooved annular tungsten carbide work roll 22 surrounds the tapered shaft portion 14. A seal flinger 24 is interposed between the inner face **22*a* of the work roll and the shaft shoulder 12. The flinger forms part of a conventional seal assembly, the remaining components of which have not been illustrated. The outer face 22*b* of the roll is provided with a plurality of integrally formed keys 22*c*, the circumferentially spaced arrangement of which can best be seen in FIG. 2**.

A tapered sleeve 26 is axially received in a tightly wedged position between the cylindrical inner wall surface of the roll 22 and the tapered shaft portion 14. The sleeve serves to securely position the roll concentrically with respect to the shaft axis "A".

A drive ring 28 is threadedly connected as at 30 to an exposed end of the tapered sleeve 26. The drive ring is splined as at 32 to the shaft end portion 16. Lug members 34 on the drive ring are axially received between and are thus rotatably engaged with on the keys **22*c* on the outer face of the roll. It will be seen, therefore, that with this arrangement, torque is transmitted from the shaft 10 to the work roll 22 via the drive ring 28**.

The flinger 24 constitutes an abutment means serving to axially locate the roll 22 along the axis A of the shaft 10. The roll is held against the flinger 24 by a first retainer means which includes the end cap 18 and a cover 36. The cover has a cylindrical side wall **36*a* which is open at the end facing towards the work roll 22, and which is closed at the opposite end by an end wall 36*b*. The end wall 36*b* is threaded to the end cap 18 as at 38. By tightening the cover 36 on the end cap 18, the open end of the cylindrical side wall 36*a* is urged against the outer face 22*b* of the roll, thus pushing the roll against the flinger 24**.

The cover 36 coacts with the end cap 18 and the outer face **22*b* of the work roll 22 to define a cylindrical chamber 40 containing the drive ring 28. The mechanical interengagement between the lugs 34 and the work roll face keys 22*c*** is thus safeguarded from exposure to cooling water and mill scale during the rolling operation.

A second retainer means serves to prevent the sleeve 26 from becoming axially dislodged from between the tapered shaft portion 14 and the inner surface of the work roll 22. The second retainer means includes a collar member 42 having a radially inwardly projecting wall **42*a*, a cylindrical skirt 42*b*, and axially extending circumferentially spaced tabs 42*c* which protrude through slots 44 in the cover end wall 36*b* to abut the drive ring 28 as at 46. A retainer bolt 48 is threaded into the end of the roll shaft. The bolt 48 has a collar 48a which bears against the end wall 42*a* of the collar member 42, thereby urging the tabs 42*c* of the collar member against the drive ring 28, the latter being threaded to the sleeve 26 at 30. The sleeve 26** is thus held in its axially wedged position.

Figure 6:
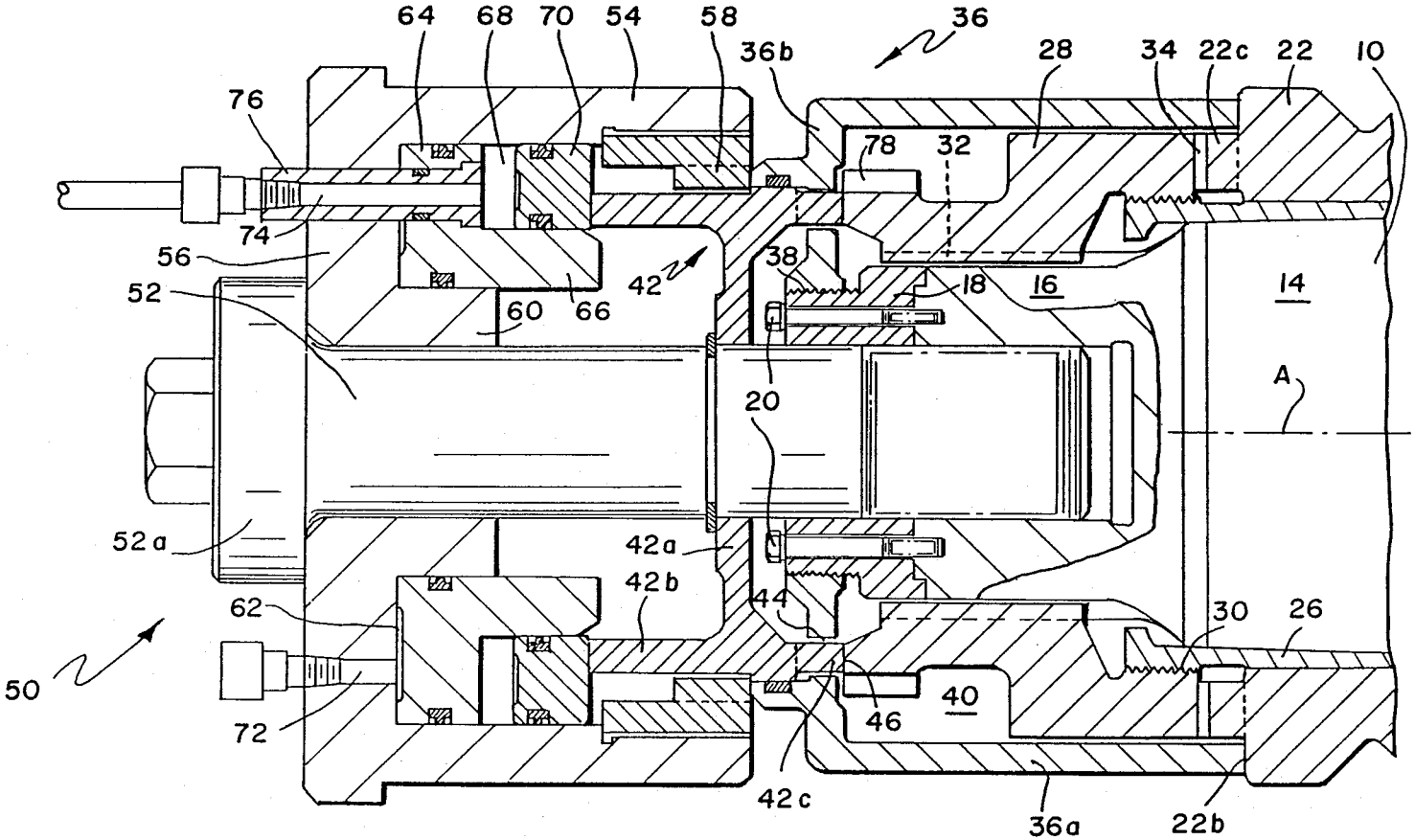
FIG. 6 is a view similar to FIG. 1 showing the application of a hydraulically actuated tool in accordance with the present invention during a roll mounting operation.

Referring now to FIG. 6, a tool 50 is employed to mount the roll assembly. The tool is carried on an extended retainer bolt 52 which is threaded into the shaft end in place of the shorter bolt 48 shown in FIGS. 1, 4 and 5. The tool includes a housing having a cylindrical side wall 54 closed at one end by an end wall 56 and having at its opposite end circumferentially spaced radially inwardly extending lugs 58. The end wall 56 has a cylindrical base 60 seated on the bolt 52. The side wall 54 and the cylindrical base 60 cooperate with the end wall 56 in defining an open ended first annular chamber 62 containing a first piston 64. The first piston 64 includes a cylindrical skirt 66 which cooperates with the housing side wall 54 to define a second annular chamber 68 containing a second piston 70. A first hydraulic port 72 in the housing end wall 56 communicates with the first chamber 62. A second hydraulic port 74 communicates with the second chamber 68. Port 74 is defined by a tubular sleeve 76 which slidably extends through the housing end wall 56 and through the first piston 64.

In the mounting mode depicted in FIG. 6, the tool end wall 56 bears against a collar 52*a* on the retainer bolt 52, and the second piston 70 bears against the skirt 42*b* of collar 42. Hydraulic fluid is admitted to the second chamber 68 via port 74 thereby axially urging the collar 42 against the drive ring 28, which by virtue of its threaded connection 30 to the sleeve 26, serves to push the sleeve into its operatively wedged position between the tapered shaft section 14 and the interior surface of the work roll 22. After the sleeve 26 has been wedged in place, the tool 50 and bolt 52 are removed, the cover 36 is tightened on the end cap 18 to bear against the outer roll face 22*b*, and the shorter retainer bolt 48 is threaded into the shaft end to bring its collar 48*a* to bear against the end wall 42*a* of collar member 42, as shown in FIG. 1.

Figure 7:
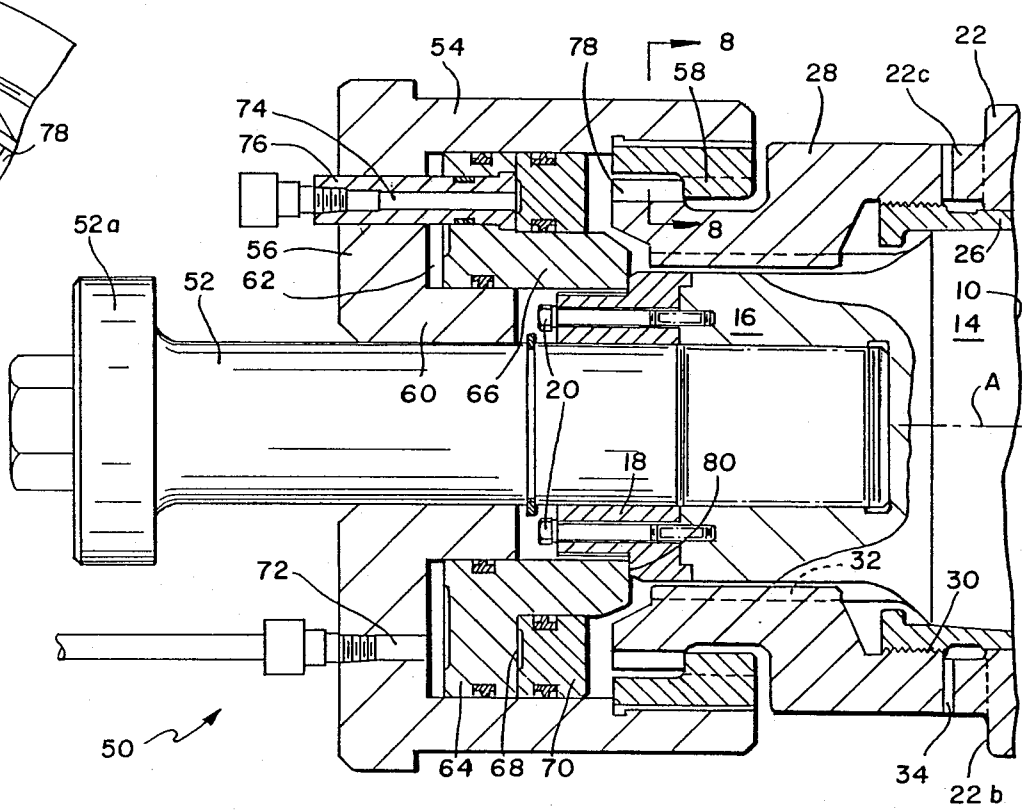
FIG. 7 is a view similar to FIG. 6 showing the application of the same tool during a roll removal operation.
Figure 8:
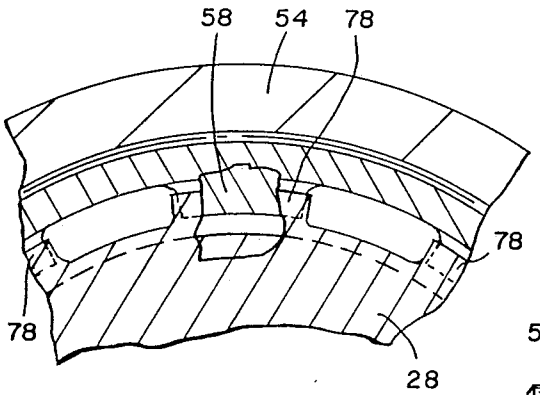
FIG. 8 is a sectional view taken along line 8—8 of FIG. 7.

In the demounting mode, as illustrated in FIGS. 7 and 8, the short retainer bolt 48, collar member 42 and cover 36 are first removed. The tool 50 and longer bolt 52 are then mounted in place, with the lugs 58 of the tool side wall 54 being axially interengaged in a bayonet connection with circumferentially spaced radially outwardly protruding lugs 78 on the drive ring 28. With the skirt 66 on the first piston 64 bearing against the end cap 18 as at 80, hydraulic fluid is admitted into the first chamber 62 via port 72. The drive ring 28 is thus pulled axially away from the work roll 22, thereby extracting the sleeve 26 from its wedged engagement between the tapered shaft portion 14 and the interior roll surface. Once the sleeve has been dislodged, the bolt 52 and tool 50 may be removed, thus clearing the way for a dismantling of the remaining components of the roll assembly.

In light of the foregoing, it now will be appreciated by those skilled in the art that the components of the roll assembly of the present invention can be rapidly and efficiently dismantled and reassembled with the aid of a single hydraulically actuated tool.

When assembled in a running condition, the work roll 22 is securely held concentrically on the tapered shaft portion 14 by the tapered sleeve 26. Torque is efficiently and safely transmitted from the roll shaft 10 to the work roll via the drive ring 28, the latter being splined to the roll shaft as at 32 and having its lugs 34 mechanically interengaged with integral keys 22c on the outer work roll face. The drive ring 28 is housed within the cover 36, the latter being threaded on the end cap 18 and serving to axially hold the work roll in place against the flinger 24. By the same token, the sleeve 26 is axially held in place by the retaining action of the collar member 42 acting on the drive ring 28.

We claim:

1. For use in combination with a roll shaft having a tapered portion and an end portion, an annular roll surrounding the tapered shaft portion and having circumferentially spaced keys in an outer face thereof, an abutment engageable with an inner face of the roll to axially locate the roll on the roll shaft, a tapered sleeve axially received in a tightly wedged position between the roll and the tapered portion of the roll shaft, an axially shiftable drive ring connected to the sleeve and splined to the shaft for rotation therewith, the drive ring having lugs rotatably interengaged with the keys on the outer face of the roll, a first retainer engageable with the outer face of the roll to axially urge the roll against the abutment, and a second retainer engageable with and acting through the drive ring to prevent axial removal of the sleeve from between the roll and the tapered portion of the roll shaft, a tool for axially shifting the tapered sleeve into and out of its wedged position between the roll and the tapered portion of the roll shaft, said tool comprising:

a cylinder defining a first open ended annular chamber containing a first annular piston, a second open ended annular chamber defined by said cylinder and said first piston, a second annular piston contained in said second chamber, means for axially fixing said cylinder in relation to said roll shaft with said second piston in contact with said second retainer, whereupon the introduction of a pressurized medium into said second chamber will cause said second piston to act in one direction against said second retainer and through said drive ring to axially shift said tapered sleeve into said wedged position, and means for axially fixing said first piston in relation to said roll shaft with said cylinder in axial interengagement with said drive ring, whereupon the introduction of a pressurized medium into said first chamber will cause said cylinder to act in the opposite direction through said drive ring to axially shift said tapered sleeve out of said wedged position.

2. The tool of claim 1 wherein said first and second chambers and said first and second pistons are coaxially aligned.

* * * * *